US012083410B2

(12) United States Patent
White, III

(10) Patent No.: US 12,083,410 B2
(45) Date of Patent: Sep. 10, 2024

(54) WHEEL TRUCK ASSEMBLY

(71) Applicant: Eugene White, III, St. Louis, MO (US)

(72) Inventor: Eugene White, III, St. Louis, MO (US)

(73) Assignee: Leo's Quad1 Evolution International LLC, St. Louis, MO (US)

( * ) Notice: Subject to any disclaimer, the term of this patent is extended or adjusted under 35 U.S.C. 154(b) by 0 days.

(21) Appl. No.: 18/063,401

(22) Filed: Dec. 8, 2022

(65) Prior Publication Data

US 2024/0189699 A1 Jun. 13, 2024

(51) Int. Cl.
*A63C 17/00* (2006.01)
*A63C 17/02* (2006.01)

(52) U.S. Cl.
CPC ..... *A63C 17/0093* (2013.01); *A63C 17/02* (2013.01)

(58) Field of Classification Search
CPC . A63C 17/0093; A63C 17/02; A63C 17/0086; A63C 17/008; A43B 3/24
See application file for complete search history.

(56) References Cited

U.S. PATENT DOCUMENTS 3,635,854 A * 1/1972 Martin ..... A63C 17/02 280/11.26
3,993,318 A * 11/1976 Rothmayer ..... A63C 17/0086 280/11.26
4,273,345 A * 6/1981 Ben-Dor ..... A63C 17/06 280/11.208
5,224,718 A * 7/1993 Gertler ..... A63C 17/004 280/11.26
8,348,284 B2 * 1/2013 Green ..... A63C 17/0086 280/11.26
2007/0252351 A1 * 11/2007 McNamara ..... A63C 17/20 280/11.24
2013/0020773 A1 * 1/2013 Green ..... A63C 17/262 280/11.214
2014/0054952 A1 * 2/2014 Krell ..... B60B 27/02 301/5.305
2014/0131962 A1 * 5/2014 Green ..... A63C 17/262 280/11.26
2018/0229103 A1 * 8/2018 Clos ..... B62K 3/002

* cited by examiner

*Primary Examiner* — Brian L Swenson
(74) *Attorney, Agent, or Firm* — Dunlap Bennett & Ludwig, PLLC

(57) ABSTRACT

A wheel truck assembly having two wheel trucks spaced apart on a base plate for supporting the skater's foot, wherein one wheel truck can be selectively removed from the base plate, and wherein each wheel truck has a two wheels that can be selectively and separately attached to and detached from the wheel truck.

6 Claims, 5 Drawing Sheets

WHEEL TRUCK ASSEMBLY

BACKGROUND OF THE INVENTION

The present invention relates to wheel trucks and, more particularly, a wheel truck assembly having two wheel trucks spaced apart on a base plate, wherein one wheel truck can be selectively removed from the base plate, and wherein each wheel truck has a two wheels that can be separately and selectively attached to and detached from the wheel truck.

Roller skates are shoes, bindings that fit onto shoes that are worn, or a base plate for supporting the user's foot to enable the user to roll along on wheels. The two most popular roller skates are the inline skate design (effectively an ice skate with wheels replacing the blade) and the "quad skate" style, comprising four wheels arranged in the same configuration as a typical car. This four-wheel configuration is advantageous over the inline skate design because the quad skate design provides greater lateral stability and has independent axles that facilitate turning (or "rocking") by pressing to one side of the skate or the other when the skater wants to create an edge.

Accordingly, quad roller skates have millions of fans, many of whom are interested in using, at different times, the many varieties of quad roller skate wheels. Users of quad roller skates may want different types of wheels for different activities—e.g., different sized wheels provide different speeds, there are indoor and outdoor wheels, and/or there are specially designed wheels that are "grippy" to allow for dance style moves. Also, many roller-skate hobbyists just want to personalize their quad roller skates' wheels. There are still more skaters who perform skating tricks with quad roller skates with only two or even only one wheel mounted onto the roller skate. Finally, quad roller skaters need, from time to time, to fix and/or properly maintain the wheels and associated components.

In sum, there are a myriad of reasons why a quad roller skater would want to remove and replace their wheels. However, the wheel of current wheel trucks for quad roller skates (and skateboards) are not easily interchangeable and so users need tools, which consume time to find and use, and it is a hassle, either to carry around tools for changing out the wheels or to carry one or more extra pairs of quad roller skates having different wheel types for when the desire for such different wheel types are desired.

As can be seen, there is a need for a wheel truck assembly having two wheel trucks spaced apart on a base plate, wherein one wheel truck can be selectively removed from the base plate, and wherein each wheel truck has a two wheels that can be selectively and separately attached to and detached from the wheel truck.

SUMMARY OF THE INVENTION

The present invention solves the disadvantages of either having to carry multiple roller skates or having to time-consumingly employ tools when a user of quad roller skates wants a roller skate with different wheel types or arrangements.

The wheel truck assembly for the roller skate (or skateboard) includes a base plate for supporting a skater's foot or an intermediate platform. In one embodiment a roller skate includes a front wheel truck secured to the underside of the base plate, along a toe portion thereof. The term "wheel truck" is intended to be interpreted broadly. More specifically, the term "truck" is utilized in the fields of skating and skateboarding to refer to a metal "T" shaped part that mounts to the underside of a board or base plate upon which the wheels are mounted. The traditional roller skate and skateboard truck includes an axil, a hangar, a kingpin and a bushing which pivots within a metal baseplate. However, "wheel truck" is not intended to be interpreted so literally herein. Instead, unless stated otherwise, the term "wheel truck" is intended to be interpreted to include any mounting structure for mounting one or more wheels to the base plate.

A sliding wheel truck removably connects to a heel portion of the base plate, wherein the sliding wheel truck has a connecting assembly for connecting the toe plate to the heel plate (or the base plate and the sliding plate). The connecting assembly may be adjustable for providing different wheelbases between the front and rear wheels.

Conventional roller skates have a pair of front wheels sharing one axle and a pair of rear wheels sharing a second axle that is parallel to the first set of wheels. Each wheel truck of the present invention may have separable first and second wheels that selectively operatively associate with the wheel truck by way of a quick release assembly. The wheel rotatably couples to the quick release assembly, thereby the latter is the independent axle for the former.

In certain embodiments, the quick release assembly has a pin that can move between a locked engagement and an unlocked engagement with the wheel truck by way of a lock switch or button, thereby enabling a user to change wheel types much faster than the prior art. The quick release assembly allows user to 'snaps on' different wheel types.

The wheel truck assembly enables a user to detach one of the base plate's wheel trucks, thereby transforming a four-wheel skate in a two-wheel skate, or even a one-wheel skate if one wheel of the pair of wheels of the remaining wheel truck is removed. Accordingly, the present invention enables a quad roller skate to transform three times on one pair of skates.

In one aspect of the present invention, a wheel truck assembly includes the following: a base plate; a first wheel truck fixed to the base plate; and a second wheel truck removably attachable to the base plate. It being understood that the first wheel truck may be the front or the rear wheel truck.

In another aspect of the present invention, the aforesaid wheel truck assembly further provides wherein the second wheel truck has a connection assembly comprising a sliding plate pin that engages the base plate in a locked engagement, wherein the connection assembly further comprises a release pin operatively associated with the sliding plate pin to move the second wheel truck between the locked engagement; further providing a core pin slot through which slides the release pin for moving between the locked engagement and an unlocked engagement with the sliding plate pin to move; and further providing an anchor plate along an underside of the base plate, wherein the anchor plate provides a receiving cavity for slidably receiving the sliding plate pin in the locked and unlocked engagements, wherein the second wheel truck provides a sliding plate dimensioned to abut the anchor plate when the sliding plate pin is received in the receiving cavity.

In another aspect of the present invention, the aforesaid wheel truck assembly provides wherein each wheel truck provides two wheels having independent axles, and wherein each axle is a quick release pin removably rotatably connectable to the wheel truck.

These and other features, aspects and advantages of the present invention will become better understood with reference to the following drawings, description, and claims.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, an embodiment of the present invention provides a wheel truck assembly having two wheel trucks spaced apart on a base plate for supporting the skater's foot, wherein one wheel truck can be selectively removed from the base plate, and wherein each wheel truck has a two wheels that can be selectively and separately attached to and detached from the wheel truck Referring now to FIGS. 1 through 9, the present invention may include a wheel truck assembly 100. The wheel truck assembly 100 has a base plate 10 for supporting one or more feet of a skater. In the context for a quad roller skate, the base plate 10 supports a boot 52. In another embodiment, the base plate may support and be connected to the underside of a skateboard.

Figure 1:
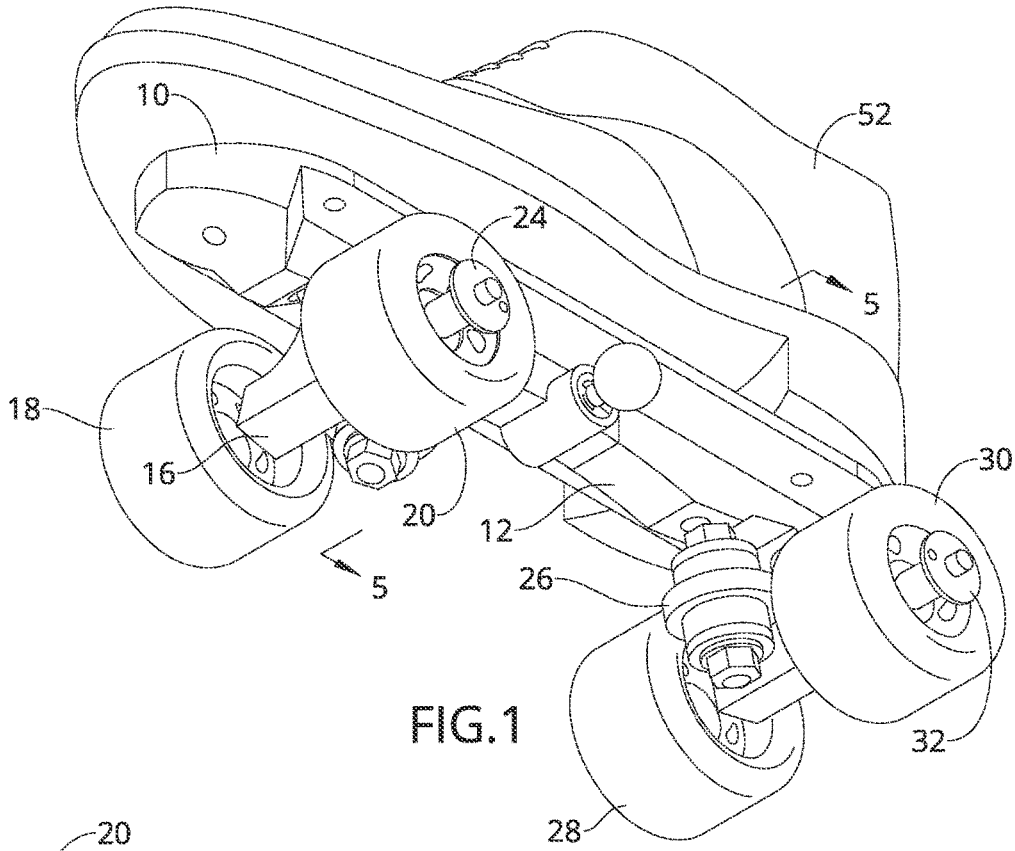
FIG. 1 is a bottom perspective view of an exemplary embodiment of the present invention, shown in use.
Figure 2:
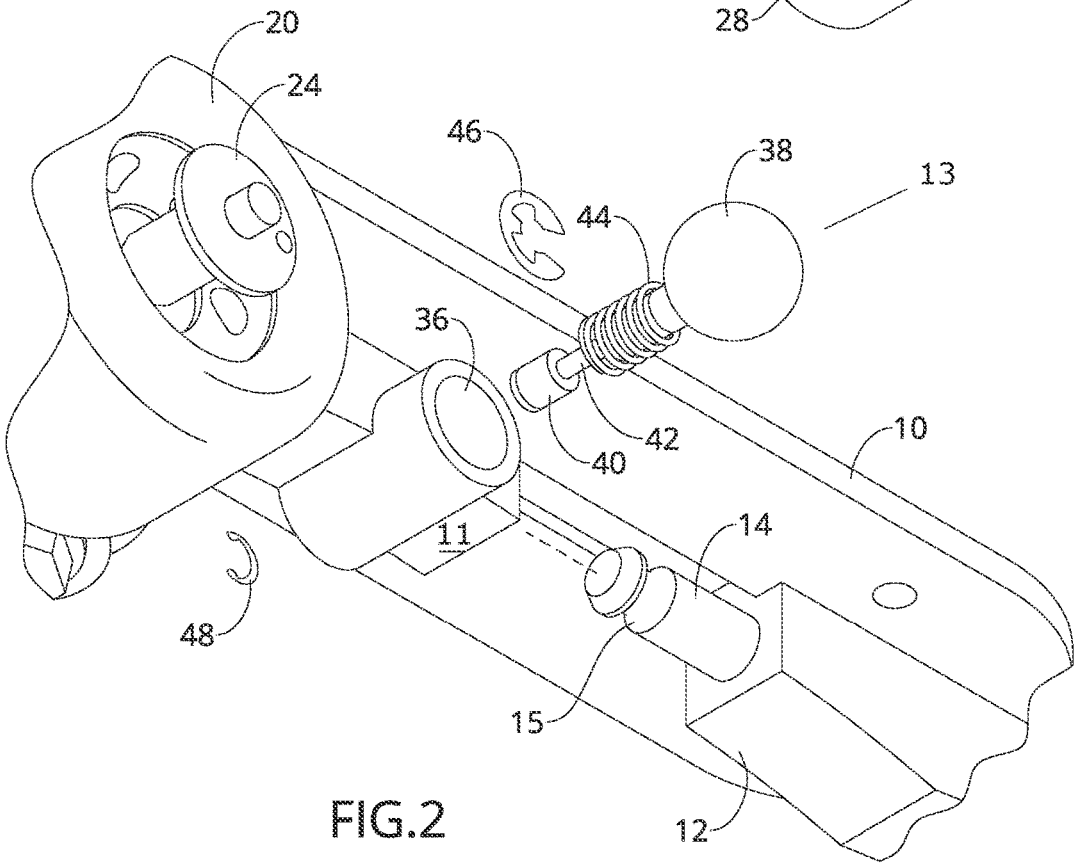
FIG. 2 is a detailed exploded bottom perspective view of an exemplary embodiment of the present invention with boot 52 not shown for clarity.
Figure 3:
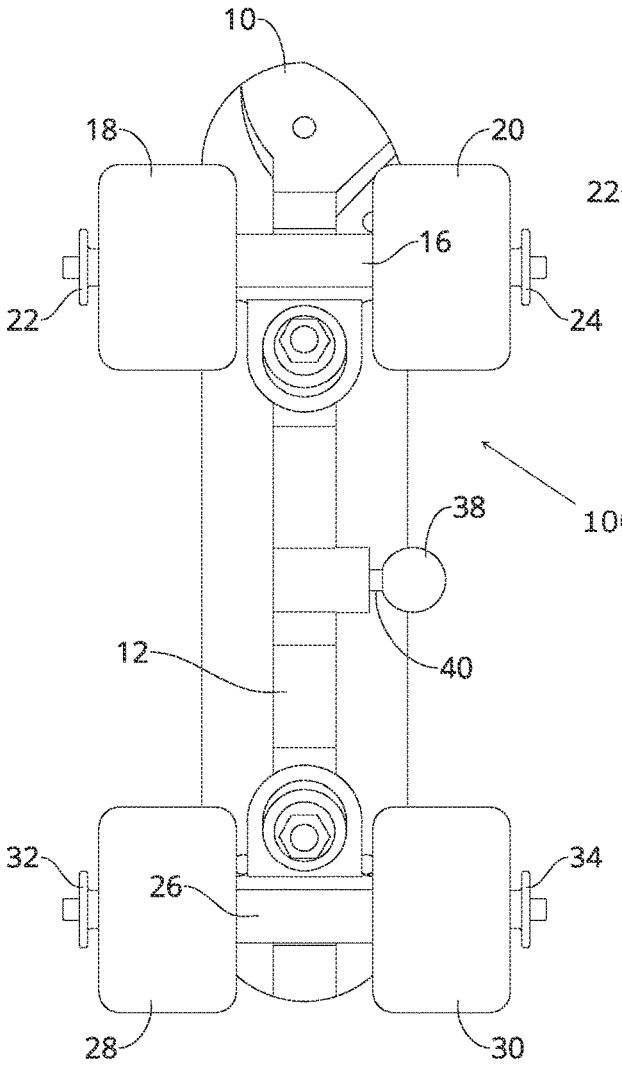
FIG. 3 is a bottom plan view of an exemplary embodiment of the present invention. Note, even though the Figures show the head or distal end of the pins 22, 24, 32, and 34 protruding significantly beyond the respective wheel hub, it should be understood that the heads of such pins could terminate at or even inward of the wheel hub as long as the invention functions as herein described.
Figure 4:
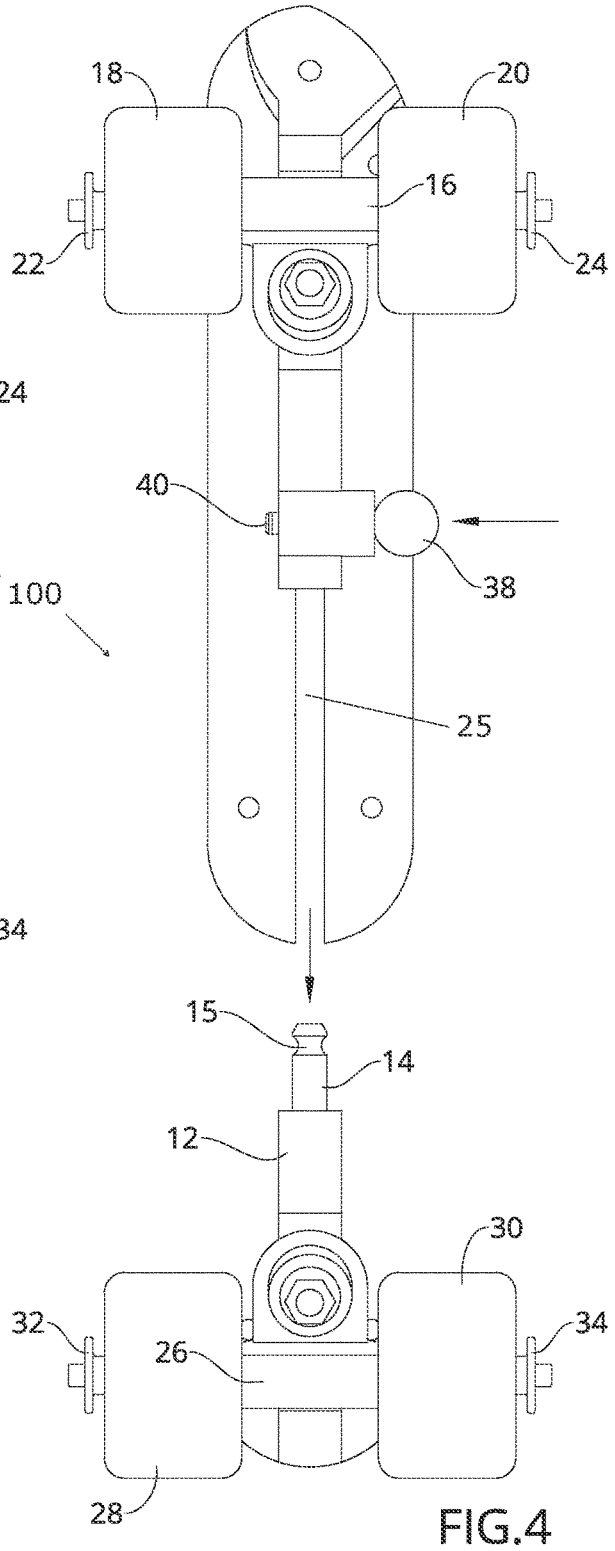
FIG. 4 is an exploded bottom plan view of an exemplary embodiment of the present invention, illustrating motion of the sliding plate 12 when being removed from the base plate 10.

The base plate 10 may have a front wheel truck 16 connected to its underside along a toe portion of the base plate 10. A channel 25 may be provided along a heel portion of the base plate 10, wherein the channel 25 is centrally disposed along the longitudinal axis of the base plate 10, and wherein the channel 25 may communicate with the rear most end of the base plate 10, as illustrated in FIG. 4. A slidable wheel truck 26 may provide a connection assembly 13 dimensioned and adapted to slidably engage the channel 25 so that the slidable wheel truck 26 may move between an engaged condition, as illustrated in FIG. 3, and a disengaged condition illustrated in FIG. 4.

The connection assembly 13 is configured to connect the sliding plate 12 to the base plate 10. The sliding plate 12 has a sliding plate pin 14 with a pin groove 15 adjacent its distal end. The connection assembly 13 may provide an anchor plate 11 (attached along the underside of the base plate 10. A distal face of the sliding plate 12 may abut a similarly shaped anchor plate 11 when the sliding plate 12 and base plate 10 are connected. The sliding plate pin 14 may extend from said distal face.

The sliding plate pin 14 may be received in a receiving cavity 50 of the anchor plate 11. A release pin 40 may be operatively associated with the receiving cavity 50 so as to form a locked engagement with the sliding plate pin 14, as illustrated in FIG. 3. The release pin 40 may be disengaged with the receiving cavity 50 so as to form an unlocked engagement with the sliding plate pin 14, whereby the sliding plate 14 may be moved away from the anchor plate 11, as illustrated in FIG. 4. As a result, the release pin 40 allows the slidable wheel truck 26 to move between the locked engagement with the anchor plate 11 and the unlocked engagement whereby the slidable wheel truck 26 may be slidably removed from the base plate 10 along the channel 25.

Figure 5:
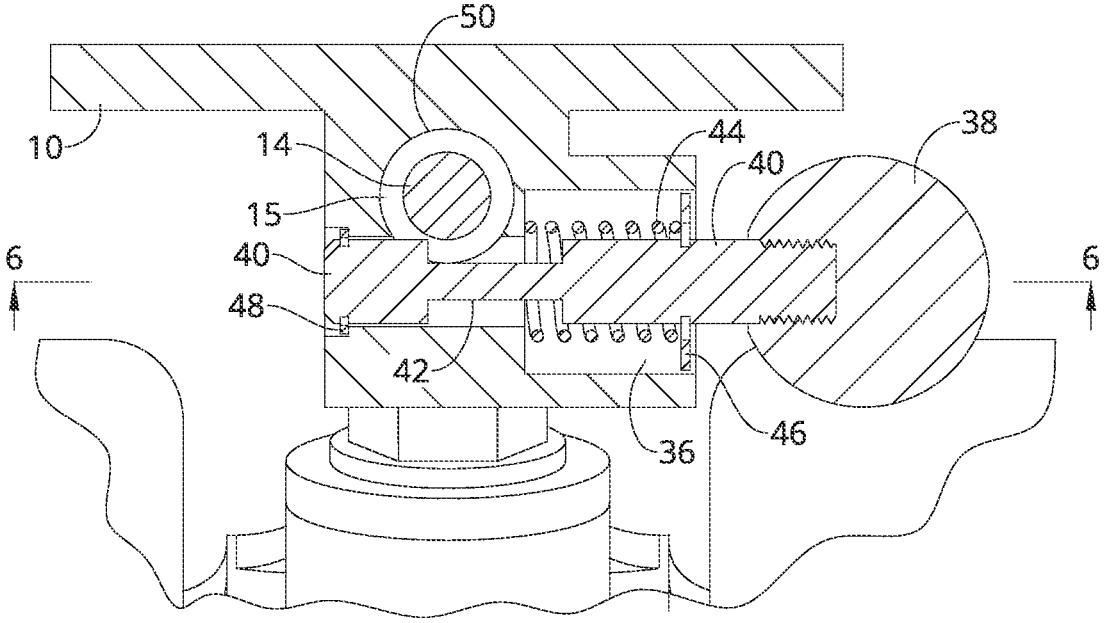
FIG. 5 is a section view of an exemplary embodiment of the present invention, taken along line 5-5 in FIG. 1.
Figure 6:
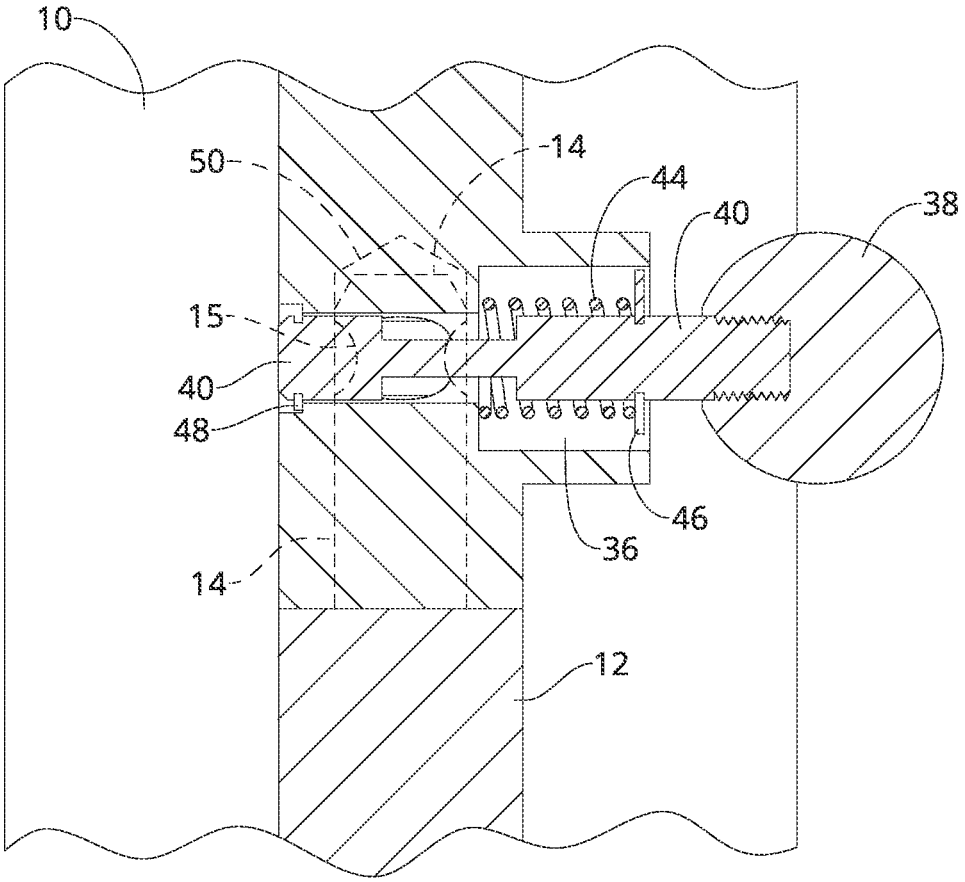
FIG. 6 is a section view of an exemplary embodiment of the present invention, taken along line 6-6 in FIG. 5.
Figure 7:
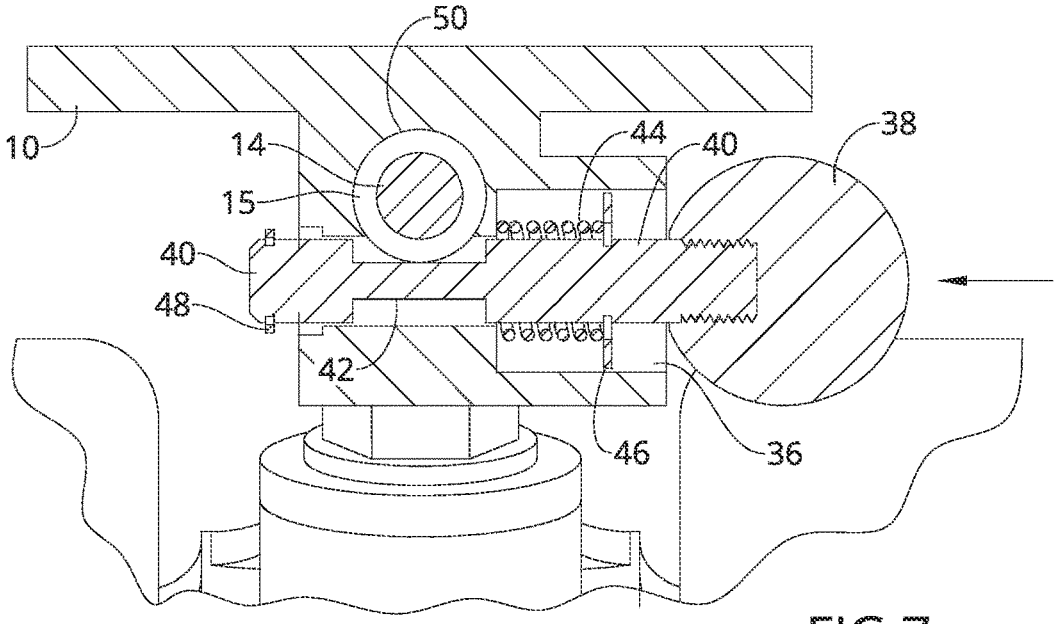
FIG. 7 is a section view of FIG. 5 showing pressing of ball 38 to create clearance at the pin pass-through groove 42 for pine 14 to be removed.
Figure 8:
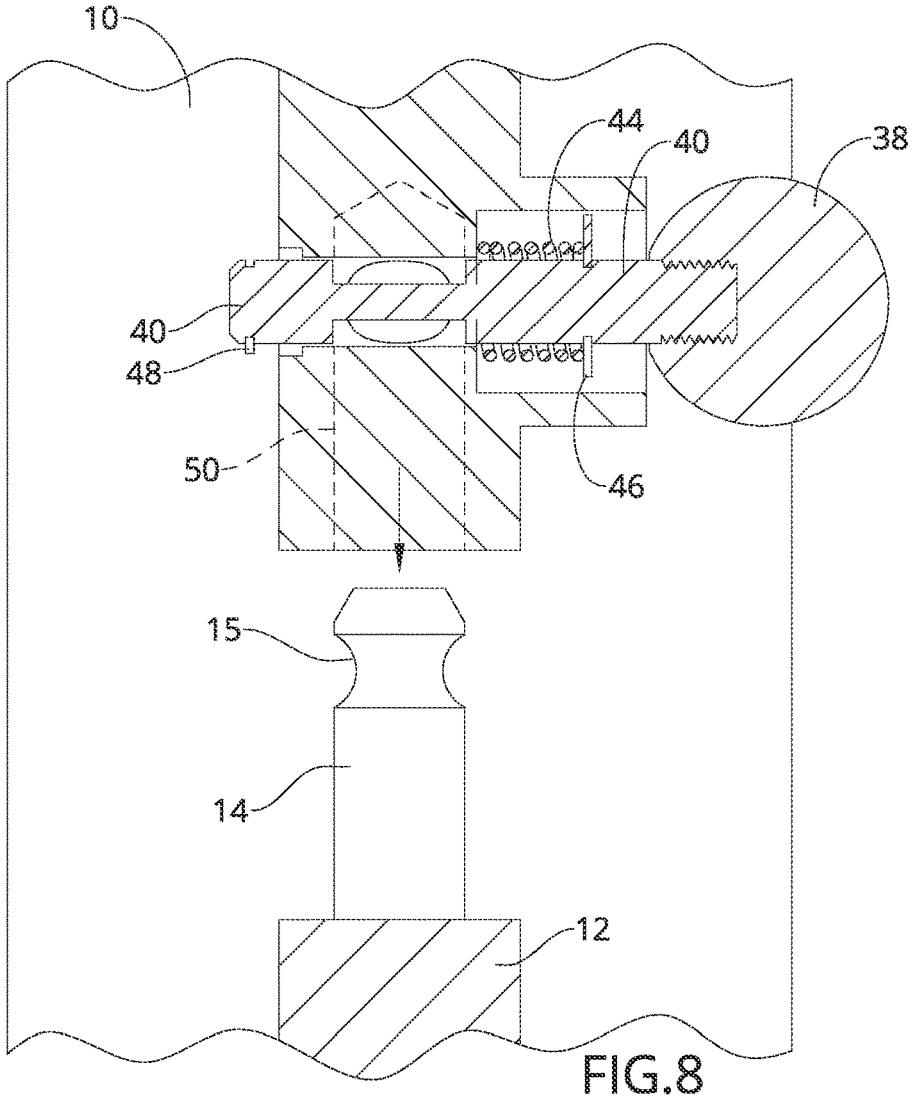
FIG. 8 is a section view of FIG. 7 illustrating sliding plate pin 14 and sliding plate 12 being removed from base plate 10.
Figure 9:
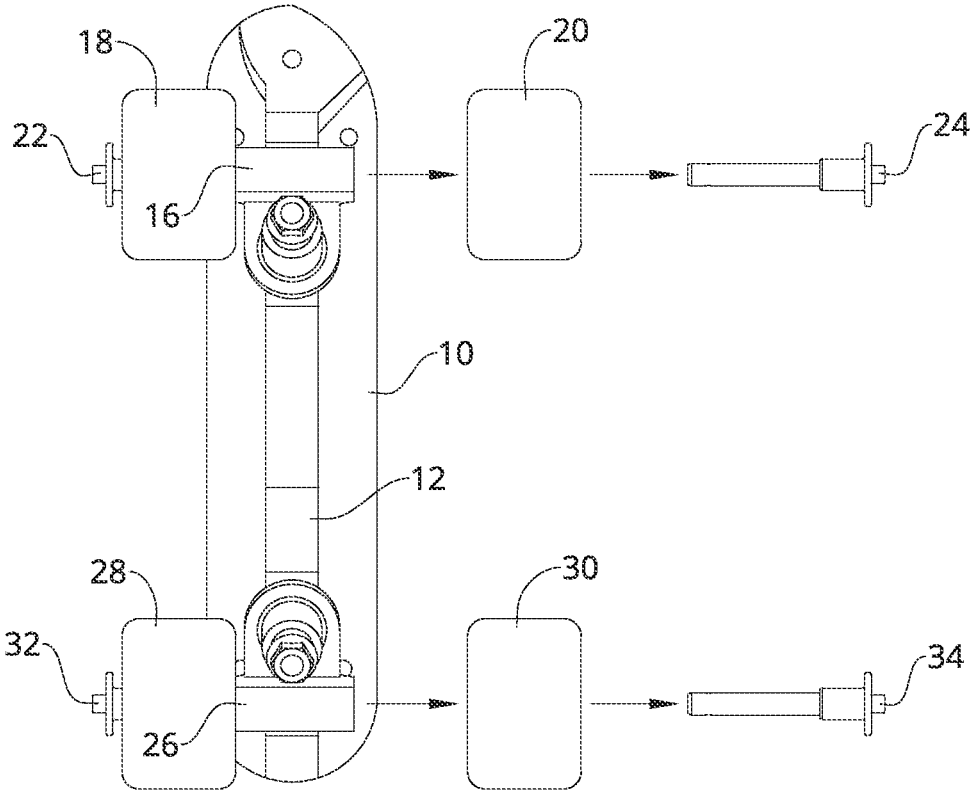
FIG. 9 is an exploded bottom plan view of an exemplary embodiment of the present invention, illustrating releasable connection of the second front wheel 20 and the second front pin 24 as well as the second rear wheel 28 its second rear pin 34.

The connection assembly 13 includes core pin slot 36 into which the release pin 40 of the connection assembly 13 slides between an engaged position (FIG. 7) and a disengaged position (FIG. 5). The release pine 40 may have pin pass-through groove 42 that, in the engaged position, engages the sliding plate pin groove 15 in the locked engagement. The release pin 40 may also have a spring 44 along its shaft as well as a first retaining ring 46 and a second retaining ring 48 for biasing the release pin 40 in the engaged position. The release pin 40 may end in a ball handle 38 to facilitate moving the release pin to the disengaged position.

The core pin slot 36 may be disposed just forward of the anchor plate 11. The spring 44 and the first retaining ring 46 may be disposed in a first chamber 61, while the second retaining ring 48 is disposed in a second chamber 62, wherein the first and second chambers 61 and 62 are spec apart by a stop 63 approximately the length of the pin pass-through groove 42.

Each wheel truck, 16 and 26, may have two wheels 18 and 20 and 28 and 30, respectively, wherein each wheel is rotatably connected to the respective wheel truck by way of a quick release pin 22 and 24 and, respectively, 32 and 34.

Each quick release pin 22, 24, 32, and 34 extends from a distal (head) end and a proximal end that removably attaches to the respective wheel truck. As a result, instead of two wheels sharing an axle, the wheels of the wheel truck assembly 100 has independent, quick release axles.

The present invention allows a user to quickly interchange different types of wheels. Furthermore, advanced skater-users can roll on the front two wheels elevating the user to a higher skill set of skating. There are professional extreme skaters who ride on one pair of wheels or can skate on the one wheel of each wheel truck. Additionally, the present invention can have upgrades such as placing a fit bit device within to keep track of steps taken, monitor heart rate, track weight loss, download music and the like, wherein the fit bit provides wireless communication capabilities. Also, the present invention can also be used for skateboarding and other hobbies, like quad skating and skateboarding, using a platform that rides on underlying quad wheel assemblies.

As used in this application, the term "about" or "approximately" refers to a range of values within plus or minus 10% of the specified number. And the term "substantially" refers to up to 80% or more of an entirety. Recitation of ranges of values herein are not intended to be limiting, referring instead individually to any and all values falling within the range, unless otherwise indicated, and each separate value within such a range is incorporated into the specification as if it were individually recited herein.

For purposes of this disclosure, the term "aligned" means parallel, substantially parallel, or forming an angle of less than 50.0 degrees. For purposes of this disclosure, the term "transverse" means perpendicular, substantially perpendicular, or forming an angle between 55.0 and 125.0 degrees. Also, for purposes of this disclosure, the term "length" means the longest dimension of an object. Also, for purposes of this disclosure, the term "width" means the dimension of an object from side to side. For the purposes of this disclosure, the term "above" generally means superjacent, substantially superjacent, or higher than another object although not directly overlying the object. Further, for purposes of this disclosure, the term "mechanical communication" generally refers to components being in direct physical contact with each other or being in indirect physical contact with each other where movement of one component affect the position of the other.

The use of any and all examples, or exemplary language ("e.g.," "such as," or the like) provided herein, is intended merely to better illuminate the embodiments and does not pose a limitation on the scope of the embodiments or the claims. No language in the specification should be construed as indicating any unclaimed element as essential to the practice of the disclosed embodiments.

In the following description, it is understood that terms such as "first," "second," "top," "bottom," "up," "down," and the like, are words of convenience and are not to be construed as limiting terms unless specifically stated to the contrary.

It should be understood, of course, that the foregoing relates to exemplary embodiments of the invention and that modifications may be made without departing from the spirit and scope of the invention as set forth in the following claims.

What is claimed is:

1. A wheel truck assembly, comprising:

a base plate;

a first wheel truck fixed to the base plate; and a second wheel truck removably attachable to the base plate, wherein the second wheel truck has a connection assembly comprising a sliding plate pin that engages the base plate in a locked engagement, and wherein the connection assembly further comprises a release pin operatively associated with the sliding plate pin to move the second wheel truck between the locked engagement.

2. The wheel truck assembly of claim 1, further comprising a core pin slot through which slides the release pin for moving between the locked engagement and an unlocked engagement with the sliding plate pin to move.

3. The wheel truck assembly of claim 2, further comprising an anchor plate along an underside of the base plate, wherein the anchor plate provides a receiving cavity for slidably receiving the sliding plate pin in the locked and unlocked engagements.

4. The wheel truck assembly of claim 3, wherein the second wheel truck provides a sliding plate dimensioned to abut the anchor plate when the sliding plate pin is received in the receiving cavity.

5. The wheel truck assembly of claim 1, wherein each wheel truck provides two wheels having independent axles.

6. The wheel truck assembly of claim 5, wherein each axle is a quick release pin removably rotatably connectable to the wheel truck.

* * * * *